United States Patent [19]

Dosmann

[11] Patent Number: 4,884,497

[45] Date of Patent: Dec. 5, 1989

[54] ONE PIECE AIR DIFFUSER

[75] Inventor: Thomas R. Dosmann, South Bend, Ind.

[73] Assignee: Continental Industries, Inc., Elkhart, Ind.

[21] Appl. No.: 223,341

[22] Filed: Jul. 25, 1988

[51] Int. Cl.[4] ..... F24F 13/06

[52] U.S. Cl. ..... 98/40.13; 98/40.21; 239/500

[58] Field of Search ..... 239/498, 500, 502, 504, 239/518, 522, 523; 98/40.13, 40.2, 40.21, 121.1

[56] References Cited

U.S. PATENT DOCUMENTS 2,353,826 7/1944 Honerkamp ..... 98/40.2

2,690,203 9/1954 Davies ..... 98/40.21

2,811,094 10/1957 Auer ..... 98/40.21

2,994,259 8/1961 O'Day ..... 98/40.13

FOREIGN PATENT DOCUMENTS 1140735 8/1957 France ..... 98/40.21

*Primary Examiner*—Andres Kashnikow

*Assistant Examiner*—Karen B. Merritt

*Attorney, Agent, or Firm*—James D. Hall; Thomas J. Dodd; Todd A. Dawson

[57] ABSTRACT

An air diffuser constructed from single piece of material, wherein the mounting member and diffuser sections are formed in a series of stamping operations and are interconnected by a plurality of integral links.

6 Claims, 1 Drawing Sheet

ONE PIECE AIR DIFFUSER

SUMMARY OF THE INVENTION

This invention relates to air diffusers and has specific reference to a one piece air diffuser.

Heretofore, air diffusers for attachment to a wall or ceiling vent opening have typically been formed from a series of coaxially displaced diffuser sections which are connected by cross frame members. Typically, the diffuser sections are formed in varying peripheral sizes and arranged in an offset manner beginning with the largest located nearest the ceiling or wall. The outermost diffuser section typically includes a hole for accommodating a vent damper control. One problem associated with prior air diffuser constructions is the cost of assembling and interconnecting the separate air diffuser sections.

The diffuser of this invention eliminates the problem associated with prior designs by providing an air diffuser in which the diffuser sections and connecting spoke or link members are integral and are formed from a single piece of metal. By forming the diffuser from a single piece of metal, assembly cost and assembly time are substantially reduced which in turn reduces overall manufacturing cost.

Accordingly, it is an object of this invention to provide an air diffuser formed from a single piece of material.

Another object of this invention is to provide a novel air diffuser which is more economical to produce.

Other objects of the invention will become apparent upon a reading of the following description.

DESCRIPTION OF THE PREFERRED EMBODIMENT

Figure 1:
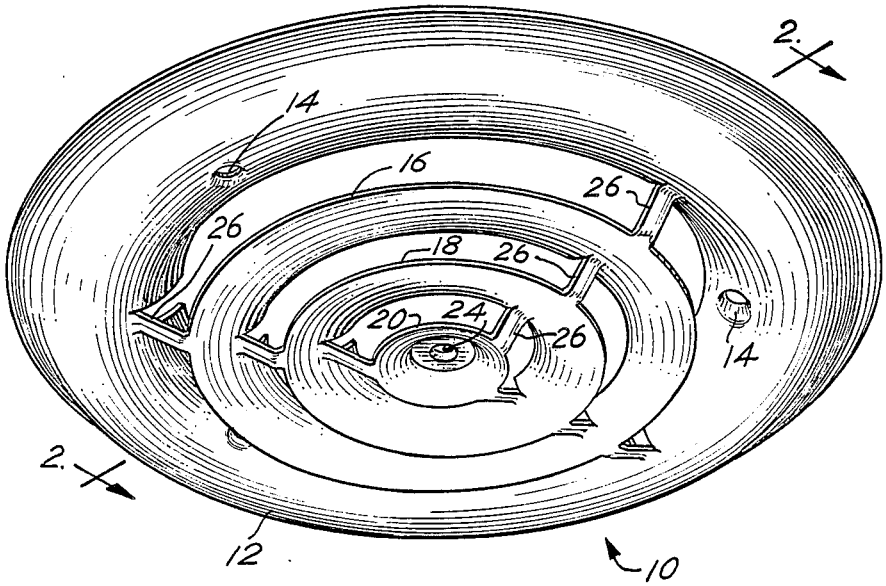
FIG. 1 is a perspective view of the diffuser of this invention.
Figure 2:
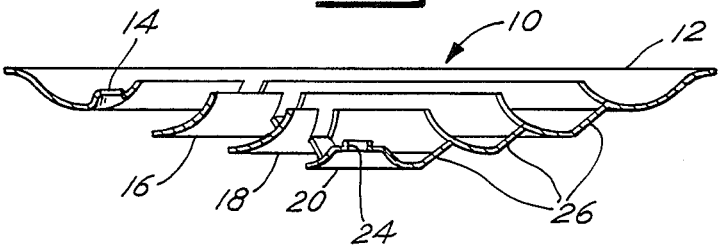
FIG. 2 is a cross sectional view of the diffuser or FIG. 1 taken along line 2—2 of FIG. 1.

The preferred embodiment herein described is not intended to be exhaustive or to limit the invention to the precise form disclosed. It is chosen and described in order to explain the principles of the invention and its application and practical use to enable others skilled in the art to utilize the invention.

As is illustrated in the figures, air diffuser 10, which in the preferred embodiment is formed from sheet metal, includes a wall or ceiling mounting ring 12 having a plurality of spaced mounting holes 14 to accommodate screws or similar fasteners. Diffuser 10 further includes annular air diffuser rings 16 and 18 which in the preferred embodiment are coaxially displaced relative to mounting ring 12, with the outer circumference of ring 18 being smaller than ring 16. An outermost diffuser ring 20 having a centrally located hole 24 is positioned coaxially spaced from rings 16, 18. Part 20 has a smaller circumference then ring 18.

The mounting ring 12 and each of the diffuser rings 16, 18, 20 have substantially uninterrupted outer edges. As illustrated in the figures, rings 16, 18 and 20 are maintained in a spaced relationship by a plurality of radial inwordly offset links 26 which extend integrally between the rings at an acute angle relative to the diffuser rings in the direction of decresing size of the diffuser rings. Each link includes an innermost and an outermost end, the outermost end of each link being connected to the next adjacent outer diffuser ring, the innermost end being solely connected to a slotted intermediate portion of the next adjacent inner diffuser ring or mounting member as the case maybe. Although the Figures illustrate three links extending between adjacent diffuser rings, it should be understood that any number of links may be used.

Air diffuser 10 is formed from a single piece of metal by a series of progressive stamping operations. It should be understood that although an annular air diffuser is illustrated in the drawings, the concept of a one piece air diffuser is equally as applicable to a multitude of shapes and dimensions, such as with square diffuser sections, and of various numbers of diffuser sections.

It is further to be understood that the invention herein described is not to be limited by the details given above, but may be modified within the scope of the appended claims.

I claim:

1. An air diffuser comprising a mounting member adapted for securement to a supporting structure and a plurality of concentric air diffuser sections, said diffuser sections displaced in parallel planes laterally outwardly from said mounting member and each other , the improvement wherein said mounting member and said air diffuser sections are formed from a single material sheet with radial inwardly offset integral links extending between the mounting member and the air diffuser sections at an acute angle relative to said planes in the direction of decreasing size of the deflectors, each of said links including an innermost and an outermost end, the outermost end of each link being connected to the next adjacent outer diffuser section, the innermost end being solely connected to a slotted intermediate portion of the next adjacent inner diffuser section or mounting member as the case maybe.

2. The air diffuser of claim 1 wherein said diffuser sections decrease in transverse dimension progressively outwardly from said supporting structure.

3. The air diffuser of claim 2 wherein said sheet material is metal.

4. The air diffuser of claim 1 wherein said diffuser sections are arcuate in cross section.

5. The air diffuser of claim 1 wherein a maximum of three of said links extend between adjacent diffuser sections.

6. An air diffuser comprising a mounting member adapted for securement to a supporting structure and a plurality of parallel angular air diffuser sections, said mounting member and each of said diffuser sections having substantially uninterrupted outer edges, said diffuser sections being spaced outwardly in decreasing transverse dimension from said mounting member, said mounting member and said air diffuser sections being formed from a single material sheet with integral links extending between the mounting member and said air diffuser sections at an acute angle relative to said diffuser section in the direction of decreasing size of the diffuser sections, each of said links including an innermost and an outermost end, the outermost end of said links being connected to the next adjacent outer diffuser section, the innermost end being solely connected to a slotted intermediate portion of the next adjacent inner diffuser section or mounting member as the case maybe.

* * * * *